US005090920A

United States Patent [19]

Casey

[11] Patent Number: 5,090,920

[45] Date of Patent: Feb. 25, 1992

[54] MODULE RETENTION/EJECTION SYSTEM

[75] Inventor: Daniel T. Casey, Harrisburg, Pa.

[73] Assignee: AMP Incorporated, Harrisburg, Pa.

[21] Appl. No.: 660,230

[22] Filed: Feb. 22, 1991

Related U.S. Application Data

[63] Continuation of Ser. No. 510,380, Apr. 17, 1990, abandoned.

[51] Int. Cl.[5] ..... H01R 13/60

[52] U.S. Cl. ..... 439/540; 439/355; 439/483; 81/488

[58] Field of Search ..... 439/544–572, 439/350–358, 540, 541, 717, 483; 81/488

[56] References Cited

U.S. PATENT DOCUMENTS

| | | | |
|---|---|---|---|
| 2,993,187 | 7/1961 | Bisbing et al. | 339/17 |
| 3,271,626 | 7/1966 | Honrilka | 317/101 |
| 3,360,689 | 11/1965 | Haury | 317/101 |
| 3,389,369 | 6/1968 | Curtis | 439/553 |
| 3,559,813 | 2/1971 | Sosinski | 211/89 |
| 3,570,096 | 3/1971 | Sosinski | 29/203 |
| 3,570.096 | 3/1971 | Sosinski | 29/764 |
| 3,767,974 | 10/1973 | Donovan, Jr. et al. | 317/101 DH |
| 3,824,525 | 7/1974 | Keller | 339/91 R |
| 3,993,390 | 11/1976 | Eigenbrode | 339/91 R |
| 4,070,081 | 1/1978 | Takahashi | 339/91 R |
| 4,168,877 | 9/1979 | Little et al. | 339/103 M |
| 4,241,966 | 12/1980 | Gomez | 339/45 M |
| 4,445,740 | 5/1984 | Wallace | 339/45 M |
| 4,477,047 | 10/1984 | Pelczarski | 439/553 |
| 4,521,063 | 6/1985 | Milc | 339/17 LM |
| 4,648,009 | 3/1987 | Beun et al. | 361/399 |
| 4,718,857 | 1/1988 | Noschese | 439/358 |
| 4,735,583 | 4/1988 | Rudy, Jr. et al. | 439/350 |
| 4,778,411 | 10/1988 | Rudy, Jr. et al. | 439/681 |
| 4,858,309 | 8/1989 | Korunsky et al. | 29/764 |
| 4,864,721 | 9/1989 | Rudy, Jr. et al. | 29/825 |

*Primary Examiner*—David L. Pirlot
*Attorney, Agent, or Firm*—Anton P. Ness

[57] ABSTRACT

A system for latching a plurality of connector modules (22) or multimodule units (18,20) in an array (10) to a panel (14) includes opposing parallel bracket assemblies (30,34) mounted to the panel and each having a plurality of latch arms (44) extending outwardly in associated opposing pairs at each module site, each adapted to be deflectable outwardly from the array. Each latch arm (44) includes a latching projection (48) latchable behind a latching surface (62) of a module or unit upon module insertion into the array. Several latch arms (44) can be ganged by a common cap (36) to be deflectable and delatchable as a unit, corresponding to several modules ganged as a unit (18,20). A tool (100) having opposing parallel arms (110) is insertable along sides (60) of a selected module (22) from rearwardly thereof to deflect the pair of latch arms (44) or pair of ganged latch arms outwardly simultaneously to delatch the module for removal, and can include ejection projections (134) to enter side recesses (70) of the module or one of the modules of a unit so that pulling the tool outwardly from the panel ejects the module or unit.

17 Claims, 7 Drawing Sheets

100
24
24
24
18
36
22
22
20
36
36
34
10
12
36
32
16
12
28
30
14
26

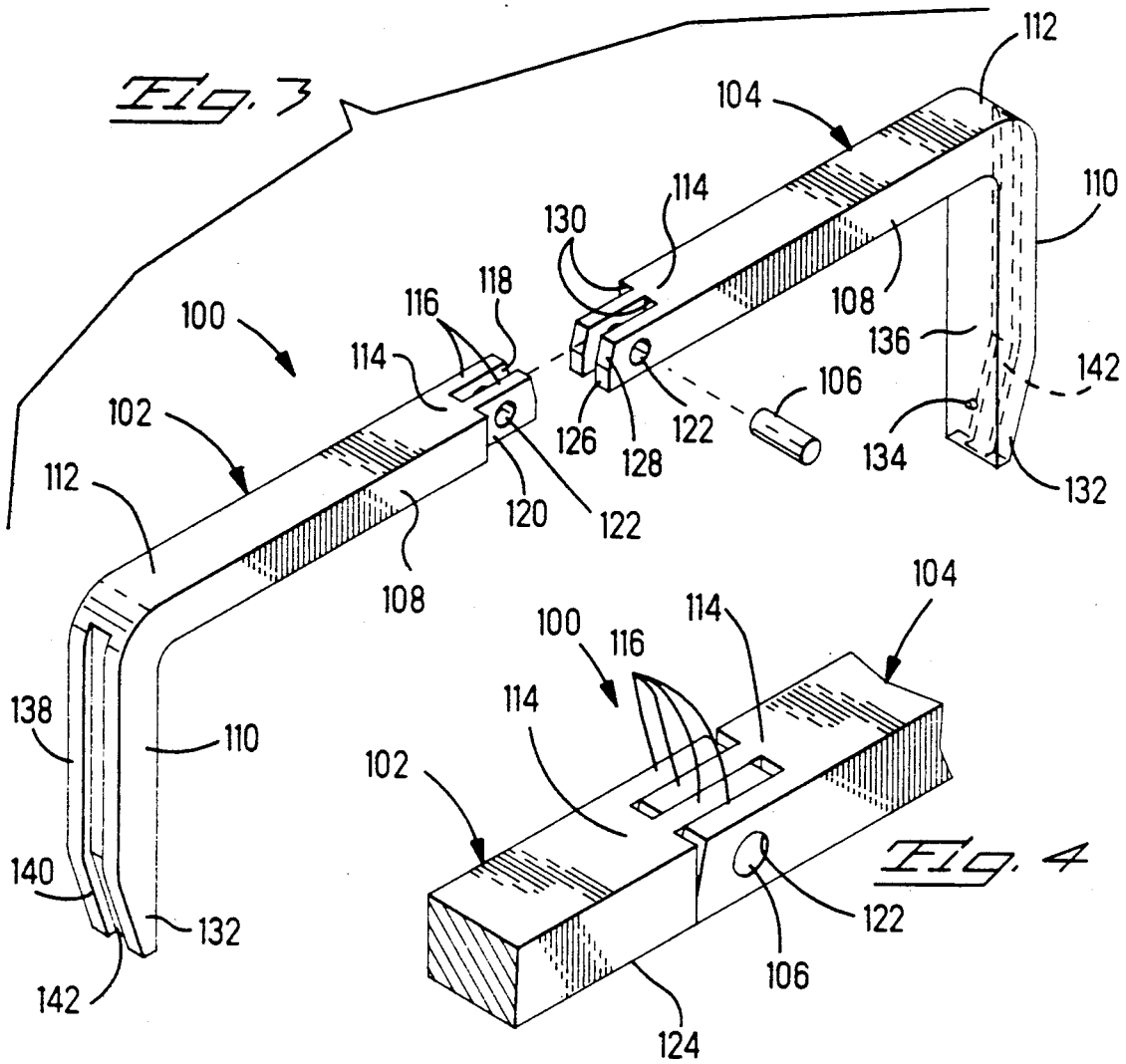
Fig. 3
Fig. 4
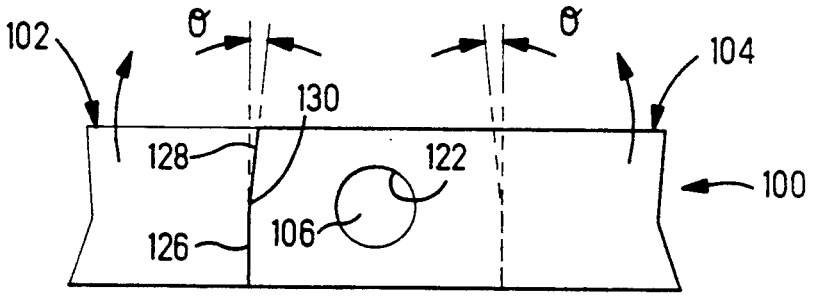
Fig. 5A
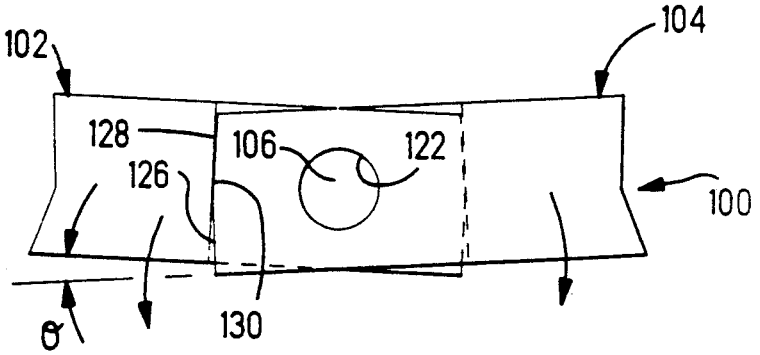
Fig. 5B

MODULE RETENTION/EJECTION SYSTEM

This application is a Continuation of application Ser. No. 07/510,380 filed Apr. 17, 1990, now abandoned.

FIELD OF THE INVENTION

This relates to the field of electrical connectors and more particularly to systems for retaining and selectively ejecting electrical connector modules of arrays.

BACKGROUND OF THE INVENTION

Arrays of electrical connectors are utilized in electronics bays of aircraft for example for integrating the wiring throughout all of the electrical systems of the aircraft including power, control, detection, indication, radio reception and transmission and so on, and for interconnecting such systems with each other and especially with black boxes for controlling or sensing. Cables of electrical conductors extend from such systems to the electronics bay in bundles or harnesses terminated thereat by electrical connectors matable with corresponding connectors in banks or arrays in a wire integration panel at the electronics bay. As disclosed in U.S. Pat. Nos. 4,735,583; 4,778,411 and 4,864,721 for example such electrical connectors may be single row modular plug connectors matable with modular receptacle connectors mounted on the panel. Typically the plug modules may be arranged in sets of two or five to be handled as a unit defining two or five rows of electrical contacts, and matable with corresponding receptacle connectors in the array having two or five rows of matable contacts. Each of the rows of contacts includes a keying system for physically encoding the row so that only the appropriate plug module can be inserted in the appropriate row of the receptacle connector.

Mating connectors typically have a means for fastening themselves together upon being mated, such as by integral latches or by spring clips as in U.S. Pat. No. 4,735,583. Especially in high vibration environments such as aircraft it is generally desirable for each module to include such a latch at each end to retain itself mated to the receptacle connector, or where the modules are ganged together for the multi-module unit to be latched to the receptacle connector at a plurality of locations at each end for vibration resistance, to assure that the connectors remain fully mated at all contact locations.

It is desirable for the means latching a module or multi-module unit to be easily delatched at both ends simultaneously for removal such as during repair or servicing.

It is further desirable for the means latching a multi-module unit to a receptacle connector to enable quick delatching for unmating the connectors, thus not requiring individual delatching of the latches at each of the multiple sites along each end.

It is also desirable for the means latching the modules and multi-module units in the receptacle connectors of an array to remain latched at all latch sites while permitting easy delatching of modules at only selected sites, thus assuring that all nearby connectors remain mated while the selected module or multi-module unit is removed such as for repair of servicing.

It is yet further desirable for the latching means to define a low profile permitting bundles of conductors to be routed close the the connector array for dense packing of multiple connector arrays in an electronics bay, and also not obstruct access to or removal and replacement of connectors of an array.

It is similarly desirable for the latching means to define a narrow profile permitting dense packing of adjacent connector arrays.

It is also further desirable for the latching means to include means for ejecting a module or multi-module unit from the receptacle connector at least a certain distance to enable manual or tool-assisted gripping of the module or multi-module unit from amid the adjacent modules closely spaced therefrom, for complete removal from the array.

It is additionally desirable for the latching means to be rugged and durable.

SUMMARY OF THE INVENTION

The present invention is a system for retaining a plurality of plug connector modules or multi-module units in an assured mated condition with corresponding receptacle connectors mounted side-by-side in an aligned array on a panel and for selectively ejecting a module or unit from such mated condition. A pair of bracket members are mounted to the panel each along and adjacent to a respective side of the array of receptacle connectors. Each bracket includes a plurality of cantilever spring latch arms extending vertically upward from the panel at each latching site, to respective free ends, each latch arm being deflectable against substantial spring bias outwardly away from the receptacle connector array. Both brackets are programmed to match the array of plug modules and correspond to the multi-module units, by the free ends of the appropriate number of adjacent latch arms being ganged appropriately by caps of appropriate length fastened thereto to act as a single latching unit.

Each latch arm includes a latch projection extending inwardly toward the receptacle connector array and downwardly toward the panel and corresponding latching surface of a plug module or multi-module unit when inserted into a receptacle connector, to latch the module or unit in a fully mated condition in the receptacle connector. Each module and multi-module unit includes at each end a respective ledge-like upwardly facing latching surface, and the latching surface can be defined by a separate member secured along a side face of a plug module; the separate member can further have a length corresponding to the number of modules being ganged together and be fastenable to each of the modules thereof and thus serve as the means securing or ganging the plug modules together.

In one embodiment the cap secured to the latch arms of a bracket can have a simple cylindrical shape extending across the free end, enabling manual deflection for manual removal of a plug module or unit. One method of making a complete bracket assembly can comprise molding a single cylindrical boss of plastic initially joining all latch arm free ends such as by a column joint extending through a hole in each free end; the single plastic boss can then be severed at locations selected to correspond with separations between separate plug modules or multi-module units and thus the bracket is easily programmable after fabrication.

In a second embodiment a tool is to be used to deflect outwardly simultaneously both latch arm caps of an opposed pair associated with a selected plug module or multi-module unit. The caps may be generally cylindrical therealong and may include a narrow guide rib extending inwardly to be received in a corresponding vertical slot along the outwardly facing surface of a corresponding work end of the tool for locating the tool work end and guiding the work end along its downward movement alongside a respective module or unit; the guide rib may be defined by forming the generally cylindrical cap to have vertical chordal surfaces to either side of the rib.

The tool used in the second embodiment is manually held and is generally U-shaped to be placed around the rear face of a plug module between the rows of conductor wires extending rearwardly from the plug modules. A pair of vertical arms depend from the ends of a horizontal portion just slightly longer than a plug module, so that the arms can extend alongside a module during use. Outside surfaces of the tool arms may include a slot to receive therein the rib of a cap for being guided thereby. Extending inwardly from the free end of each tool arm is a projection to be placed under a corresponding downwardly facing ledge of a side of a plug module for the projections of both tool arms together to enable the tool to lift a selected plug module or unit when the tool has been fully positioned. The horizontal portion of the tool can consist of two sections secured together at a centrally located pivot point such as by a pin extending through aligned holes of a pair of plate-like end sections of each horizontal section, the plate-like end sections of each horizontal section spaced appropriately by a vertical slot to receive therebetween one of the plate-like end section of the other. The two sections of the tool are slightly pivotable with respect to each other about the central pivot point defined by the pin, and pivoting is controllably stopped by end faces of the plate-like end sections abutting the opposing surface at the bottom of the slot between the other plate-like end sections with which they are interleafed; the end faces can include two surfaces about 3° apart to allow tool pivoting through an angular distance of 3°, for example.

During the downward movement of the tool, the tool arms deflect the opposed caps of the bracket members outwardly to delatch the latch projections of the latch arms from the plug module. Upon completion of the downward stroke the latch arms with the tool arm projections are now opposed from the location of the downwardly facing surface of the side of a plug module, and the latch arms urge the tool arms inwardly and the projections under the downwardly facing surfaces, all permitted by the slight pivotability of the two sections of the tool. When the tool is now lifted, the tool arm projections lift up the plug module or unit. During the removal or ejection of the selected plug module or unit from its receptacle connector, the other plug modules or units remain assuredly latched in their mated condition by the other latch arms which remain unaffected by the tool.

It is an objective of the present invention to provide a retention/ejection system separate from but cooperable with mating plug and receptacle connectors of a panel-mounted array for retaining the connectors in mated condition while permitting selective removal of a plug from a receptacle of the array.

It is another objective to provide for easy actuation of the retention/ejection system when desired which system otherwise retains the mated connectors assuredly mated in a high vibration environment.

It is also an objective to provide such a system which is programmable to permit actuation of several fastening portions thereof as a unit during mating and removing of a multi-module plug connector unit from a corresponding receptacle connector.

It is an additional objective to provide such a programmable retention/ejection system which has a low and narrow profile to be suitable in a crowded electronics bay having many connector arrays, array panels and conductor bundles densely packed.

It is a further objective to provide such a system which is durable and rugged, is easily fabricated with precision and has few separate parts.

Embodiments of the present invention will now be described with reference to the accompanying drawings.

BRIEF DESCRIPTION OF THE DRAWINGS

FIGS. 3, 4, 5A and 5B are views of the tool of FIG. 1, with FIG. 3 showing the sections of the tool exploded, and FIGS. 4, 5A and 5B showing the pivotable central portion after assembly in perspective and showing the limits of the pivotable movement thereof, respectively;

DETAILED DESCRIPTION OF THE PREFERRED EMBODIMENTS

Figure 1:
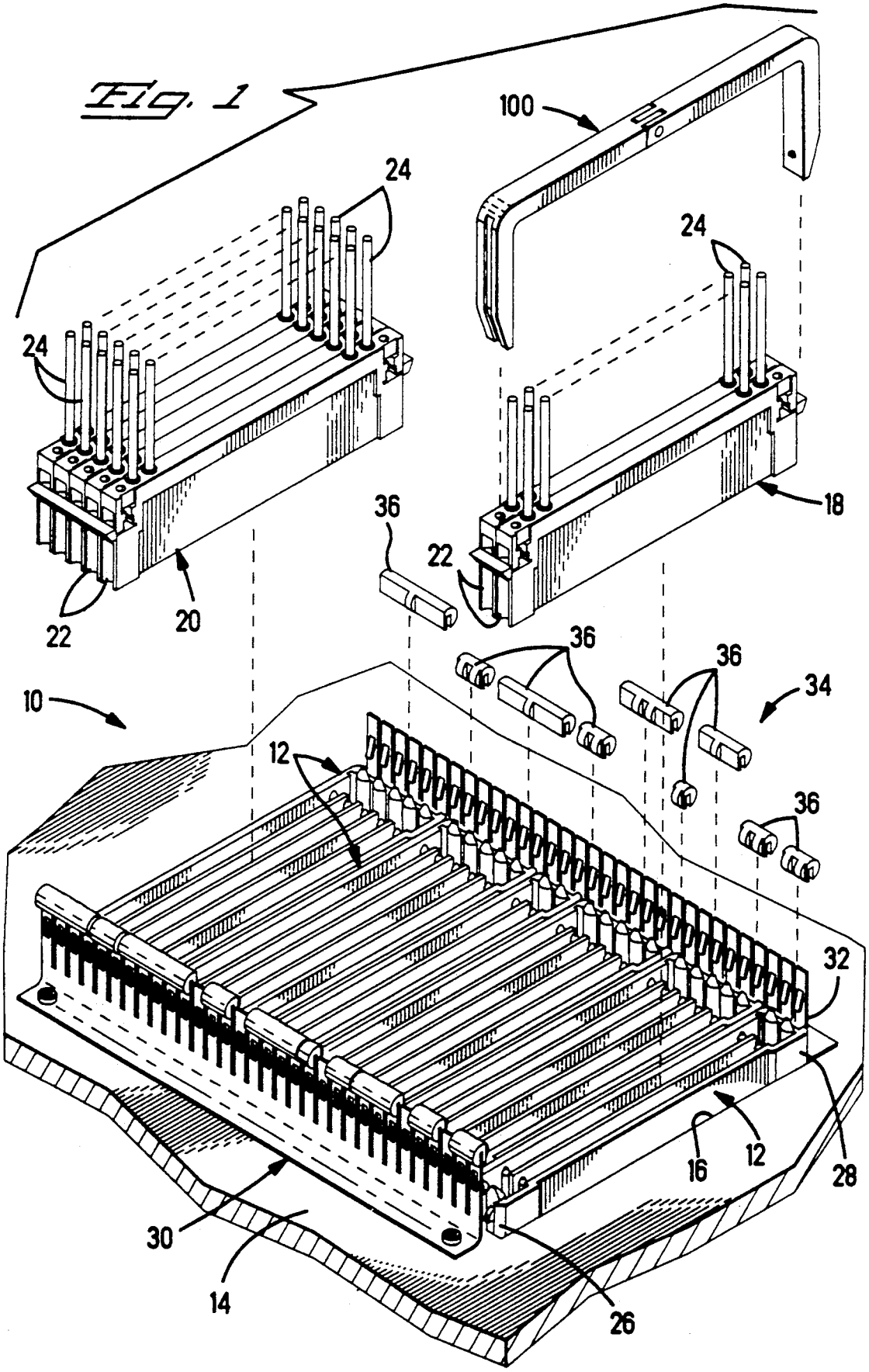
FIG. 1 is a perspective view showing a panel-mounted array of receptacle connectors and representative mating plug modules and multi-module units exploded therefrom, with one embodiment of the retention/ejection system of the present invention having a tool.

In FIG. 1 a connector array 10 includes a plurality of receptacle connectors 12 mounted to a panel 14 in a large cutout 16 thereof. Plug connectors are represented by a two-module plug unit 18 and five-module plug unit 20, each plug module 22 thereof being a single-row connector for terminating a single row of conductors 24. Mounted to panel 14 along a first side 26 of array 10 is a bracket assembly 30 of the present invention, while shown mounted to panel 14 along the opposed side 28 is a bracket member 32 of the present invention, for an opposed assembly 34, with caps 36 of varying lengths exploded therefrom. A tool 100 is shown aligned above the two-module plug unit 18 as if to be used for removal thereof from the array.

Figure 2:
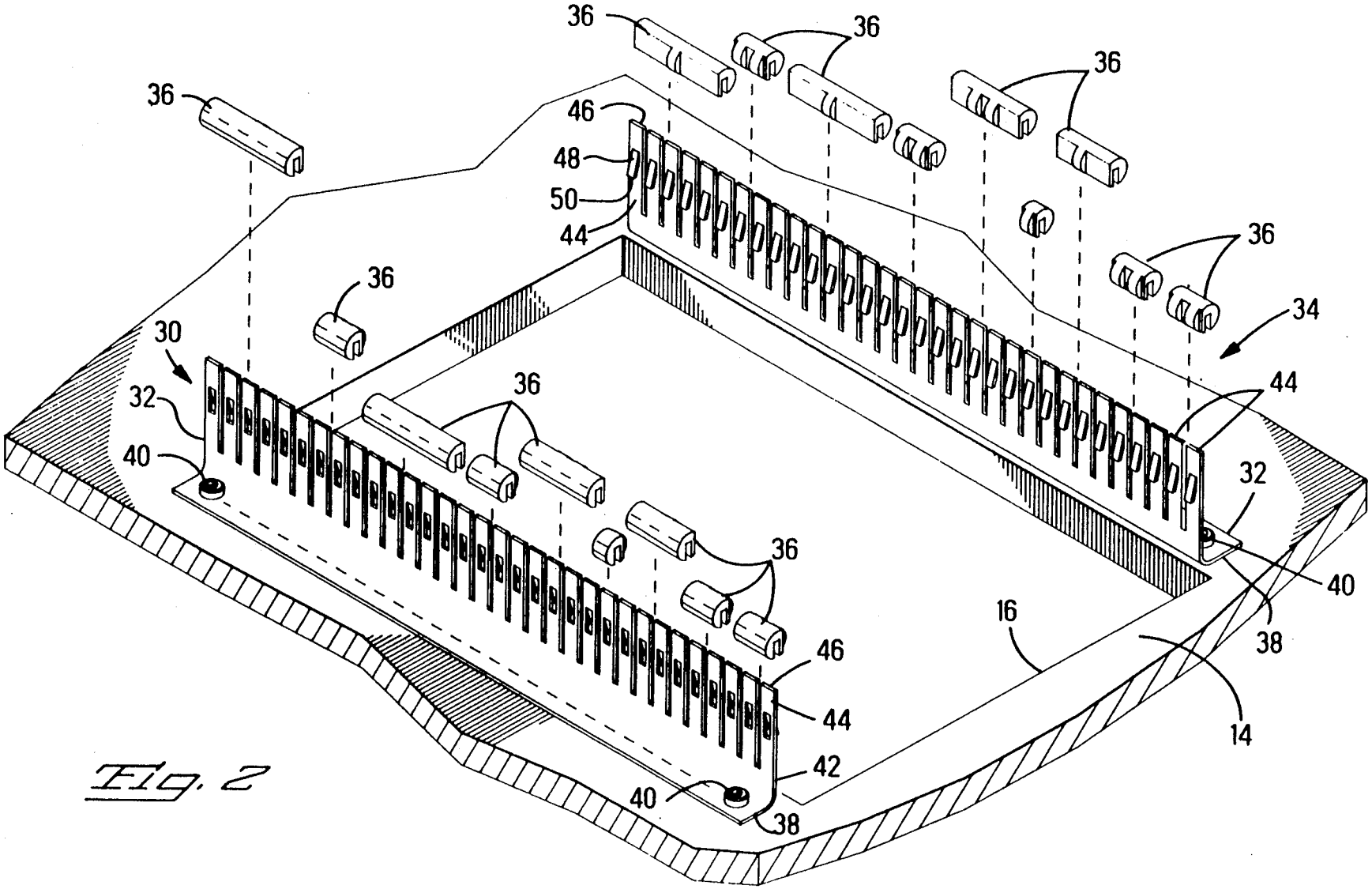
FIG. 2 is a perspective view of the panel-mounted bracket members retention/ejection system of FIG. 1, with caps exploded from the plurality of latch arms.

Referring to FIG. 2, each bracket member 32 includes an integral base section 38 mounted to panel 14 such as by bolts 40 at least at each end. Extending upwardly from an upturned portion 42 of base section 38 are a plurality of cantilever spring latch arms 44 spaced and dimensioned to correspond with each plug module site of a receptacle connector 12 of FIG. 1. Each latch arm 44 extends upwardly to a free end 46 and midway therealong includes a latch projection 48 extending to a latching end 50 downwardly and inwardly toward the cutout in which will be mounted the array 10 of receptacle connectors 12. A plurality of caps 36 of the first embodiment of the invention are shown each of which will be fastened to free ends 46 of one or more latch arms 44 and which is generally cylindrically shaped, discussed in greater detail with respect to FIG. 8.

Tool 100 is shown in FIGS. 3, 4, 5A and 5B and has two opposed sections 102,104 securable together with a pin 106 in a manner permitting a controlled, limited amount of relative pivoting about pin 106. As shown, sections 102,104 are hermaphroditic and each includes a horizontal portion 108 and a vertical arm 110 depending from an outer end 112 thereof. Horizontal portion 108 concludes at an inner end 114 having a pair of vertical plate-like end sections 116 spaced apart by a vertical slot 118, with a vertical recess 120 alongside one of them; inner ends 114 thus are so designed to cooperate with each other with plate-like end sections 116 of each interleafed with those of the other. Plate-like end sections 116 include pin-receiving holes 122 therethrough located to be precisely aligned when inner ends 114 of sections 102,104 are appropriately meshed during assembly for pin 106 to be force fit thereinto. When tool 100 is assembled, horizontal portions 108 together define a bight 124 pivotable at its center about pin 106, with vertical arms 110 depending from its ends a distance apart just slightly greater than the length of a plug module 22 (FIG. 1) with which it will be used during connector removal or ejection, so that vertical arms 110 can coextend along side faces of the plug module, as seen in FIGS. 6A and 6B.

As illustrated in FIGS. 5A and 5B, to enable controlled and limiting pivoting of tool sections 102,104 about pin 106, inwardly facing end surfaces of each plate-like end section include upper and lower portions 126,128 at a slight angle from each other; upon pivoting about pin 106 the lower surface portions 126 engage the opposing surface 130 of a slot 118 or recess 120 to define an inner pivot stop as in FIG. 5A, and the upper surface portions 128 likewise engage opposing surface 130 to define an outer pivot stop as in FIG. 5B. Preferably only 3° of rotation is need for relative pivoting of tool sections 102,104 so upper and lower surfaces 126,128 correspondingly are at a 3° angle.

Tool 100 is to be used to deflect outwardly simultaneously both latch arms 44 of an opposed pair thereof associated with a selected plug module 22 or multi-module unit such as unit 18 or 20 of FIG. 1. Vertical arms 110 extend to ends 132 which define a pair of work ends of the tool and include projections 134 aligned with and extending inwardly toward each other from inside surfaces 136 of arms 110. Outside surfaces 138 are adapted to engage caps 36 secured on free ends 46 of latch arms 44 and are tapered inwardly at 140 to facilitate outward deflection of cantilever spring latch arms 44 upon engagement. Along outside surfaces 138 are respective vertical guide channels 142 associated with corresponding vertical ribs of caps 36 to align and guide arms 110 of tool 100 during downward movement thereof (FIG. 8).

Figure 6A:
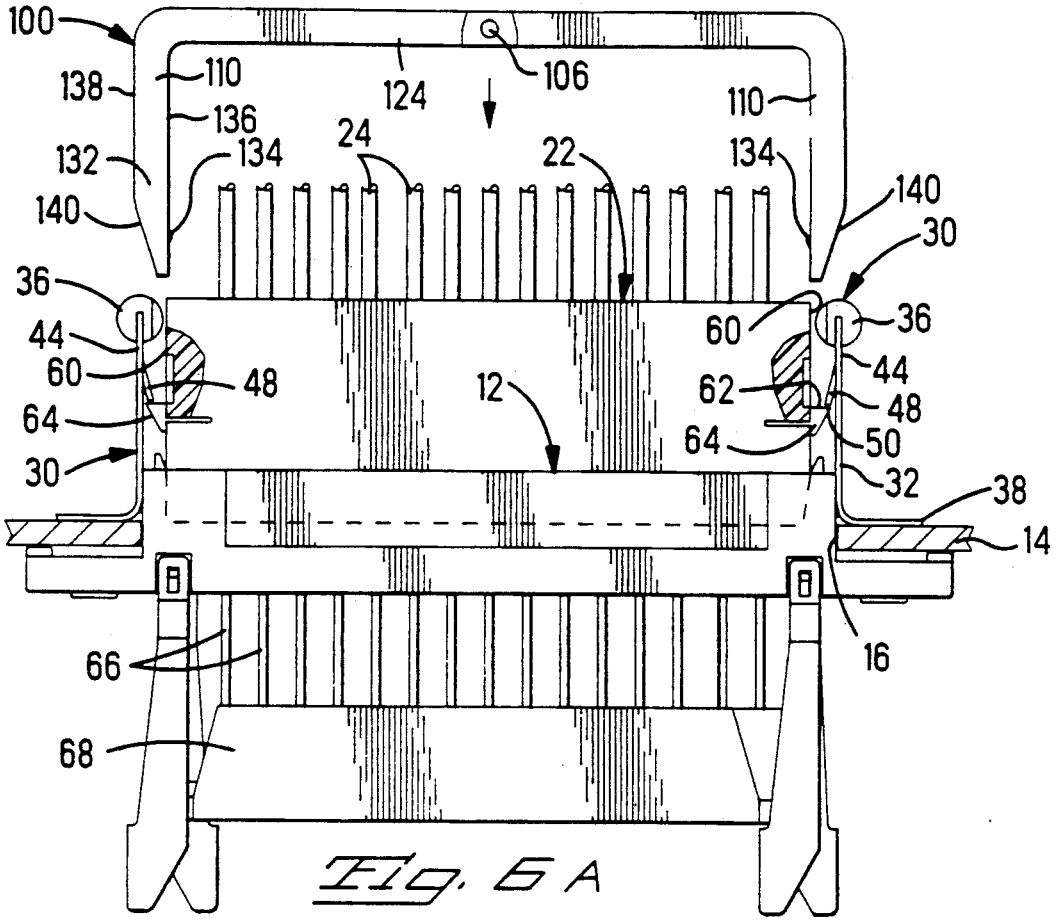
FIGS. 6A and 6B demonstrate use of the tool to remove a module, with the tool about to be moved downwardly in FIG. 6A and the tool fully inserted and engaging a plug module in FIG. 6B for removal thereof from a receptacle connector.
Figure 6B:
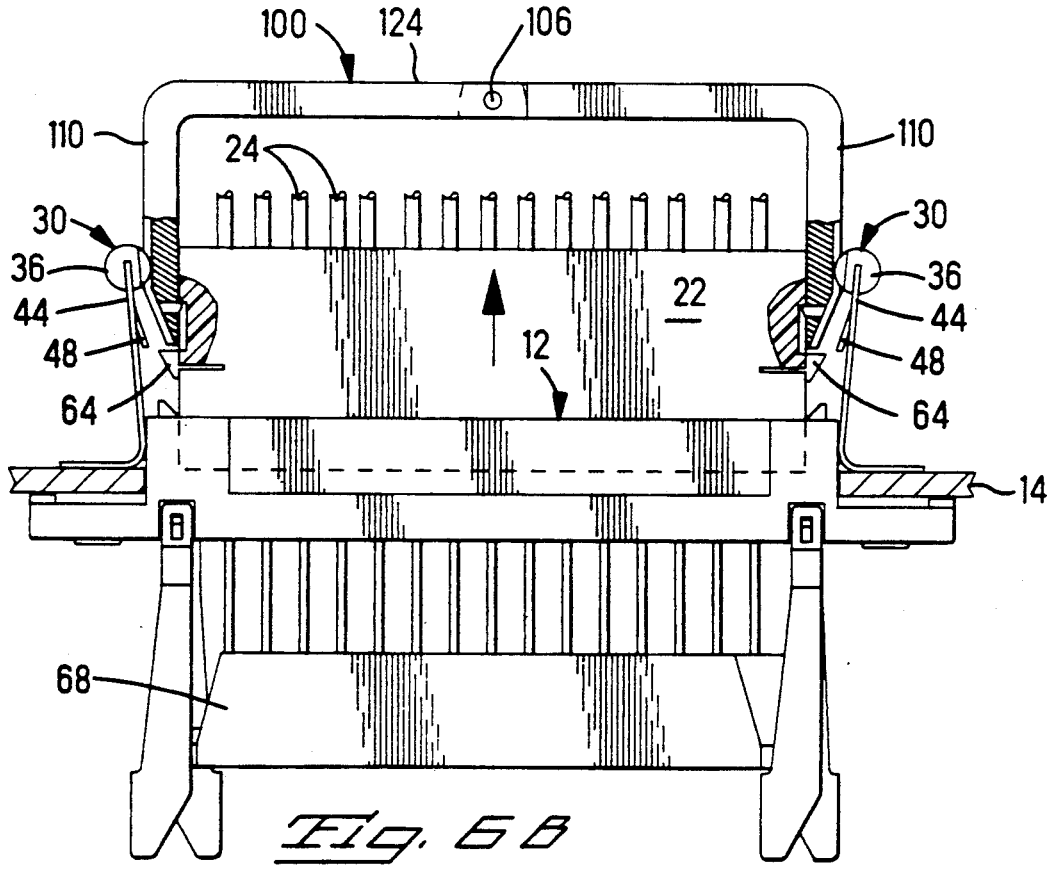
Figure 7B:
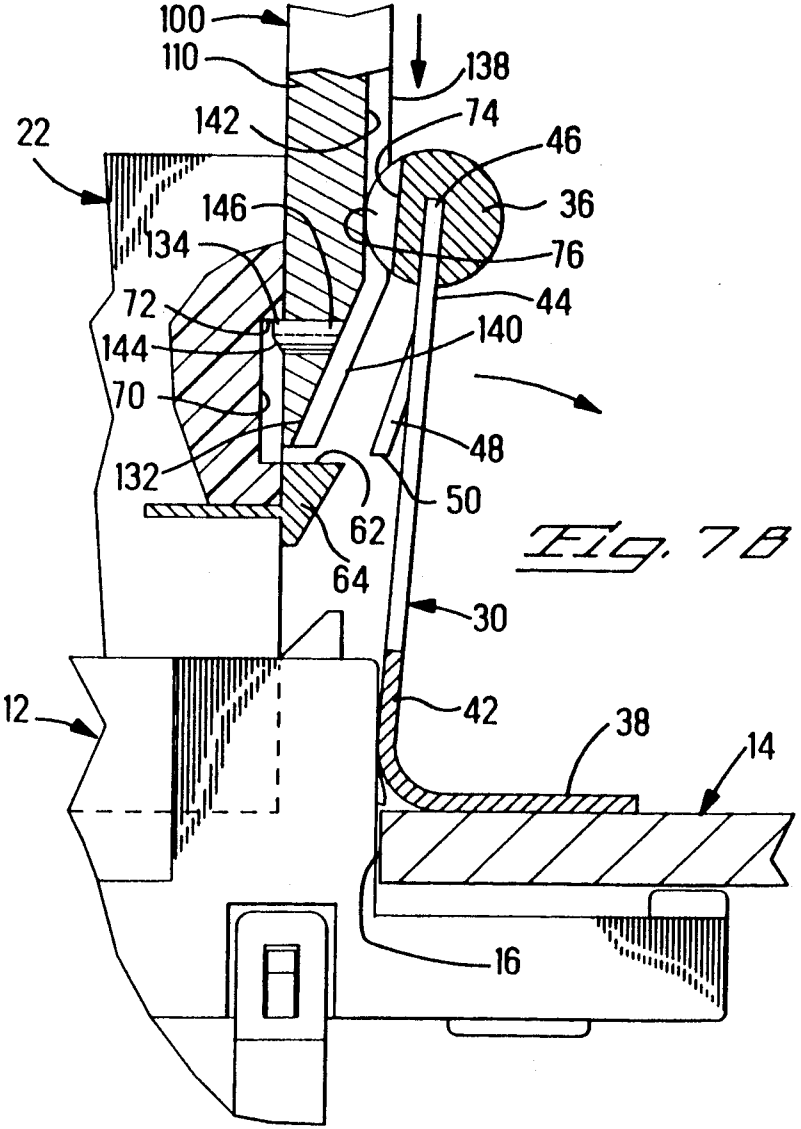
FIGS. 7A and 7B are enlarged views of a latching site of one end of a plug module, before and after insertion of a tool, corresponding to FIGS. 6A and 6B.
Figure 7A:
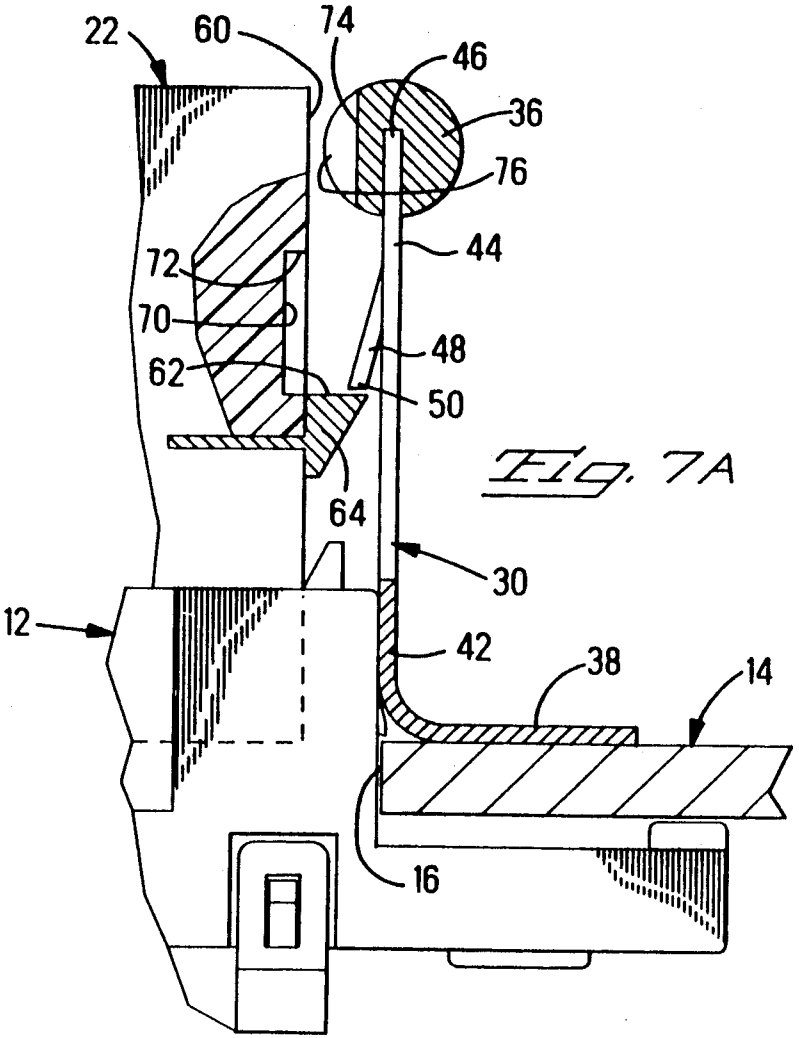

In FIGS. 6A and 7A a plug module 22 is shown latched in a fully mated condition with a receptacle connector 12 mounted in cutout 16 to panel 14, by opposed latch arms 44 at both side faces 60 of plug module 22. Latching engagement is attained by latch end 50 of latch projection 48 extending downwardly from each latch arm 44 against upwardly facing latching surface 62 of a ganging member 64 secured to plug module 22 at each side face 60. Conductors 24 are shown extending from plug module 22, which can be temporarily deflected aside for use of tool 100 which has a narrow profile enabling use in a dense array of conductors extending from adjacent plug modules as well, even with several single-row arrays of conductors extending from several plug modules of a multi-module unit but then bundled together at a location rearwardly from the modules. An array of wire wrap post terminals 66 is shown extending below receptacle connector 12 for electrical interconnection to those of other connectors as desired; secured over the posts is a removable post protector 68 latched to receptacle connector 12.

In FIGS. 6B and 7B tool 100 has been fully inserted over a selected plug module 22: work ends 132 of tool arms 110 have deflected outwardly caps 36 secured on latch arm free ends 46 against spring bias, thus disengaging latch projections 48 from ganging members 64; in turn, latch arms 44 have also urged work ends 132 of tool arms 110 inwardly after projections 134 have passed along a portion of module side faces 60 to an inward recess 70, thus moving projections 134 into ejection position beneath downwardly facing surfaces 72 of plug module 22, an action permitted by the slight amount of pivotability built into the preferred embodiment of tool 100. Simple upward manual pulling on tool 100 will now lift and eject plug module 22 from receptacle connector 12; pulling upward near the pivot pin 106 of tool 100 will tend to urge outward ends 112 of horizontal portions 108 downwardly and work ends 132 of vertical arms 110 inwardly against side faces 60 of plug module 22 to maintain projections 134 in place beneath surfaces 72 as arms 110 disengage from caps 36 and the inward spring bias applied by latch arms 44. Thus tool 100 can eject a plug module 22 or multi-module unit at least far enough for more assured grasping thereof by hand or by another tool.

Figure 8:
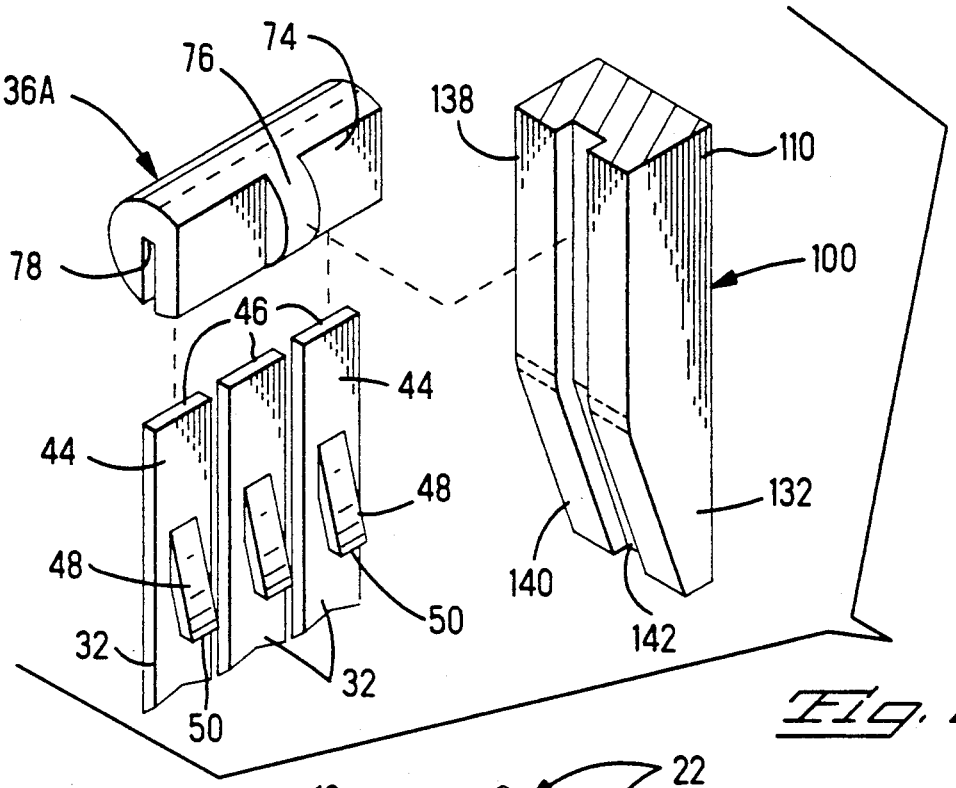
FIG. 8 is an enlarged perspective view illustrating a cap removed from a plurality of latch arms, and a tool end cooperable therewith during module ejection.

Referring to FIGS. 7B and 8, caps preferably are cylindrical along aligned free ends 46 of latch arms 44 but include a vertical chordal surface 74 facing the connector array, and centrally along the length thereof further include a guide rib 76 (or two thereof) associated with vertical slot 142 of tool arm 110. As tool 100 is urged downwardly at a location aligned with guide rib 76, guide rib 76 enters slot 142; the tapered slot bottom initiates outward deflection of cap 36 on latch arm free end 46, disengaging latch projection 48 from ganging member 64. Centrally located guide rib 76 is aligned with the center one of the plug modules of a multi-module unit so that projection 134 of tool 100 is aligned with a plug module for ejection engagement. Preferably projection 134 includes a beveled lower corner 144 to minimize snagging with a rear surface of plug module 22 when initially passing the rearward end of side face 60 thereof; projection 134 may be a cylindrical member 146 made of a very hard metal such as 01-Tool Steel for improved wear resistance, and may be assembled to tool 100 such as by being press-fit into an incrementally smaller hole through tool arm 110.

In FIG. 8, a cap 36A of a length appropriate for ganging three latch arms together as a unit, has its guide rib 76 centrally located so that tool 100 will be correspondingly located at the center of a three-module unit. Because guide rib 76 is centrally located, the three latch arms 44 will be deflected as a unit, with no torque applied by tool 100 to the ganged latch arms which would occur were tool 100 to deflect one of the outer two latch arms, which could result in incomplete delatching of the other outer latch arm from the three-module unit; also, the three-module unit will also be ejected at the center module thus tending to keep the unit vertically aligned during ejection. For caps used with an even number of latch arms for a unit of an even number of plug modules 22 (FIG. 2), a pair of guide ribs would be centrally located, each associated with a respective plug module of the unit, either one of which would effectively delatch the ganged latch arm set and assure the tool engagement with one of the two central plug modules of the unit for ejection. A cap 36 may be secured to a latch arm free end or ends 46 such as by receiving free ends 46 within a channel 78 and being bonded thereto such as by a bead of high adhesion glue along the bottom of channel 78, or by being pinned to at least one of the latch arm free ends by a roll pin inserted through aligned holes of cap 36 and free end 46 (not shown). Boss members 36 may be machined of aluminum, for example; bracket members 32 may be made of a stiffly resilient metal such as stainless steel for sufficient spring properties of cantilever spring latch arms 44, in order to maintain the plug modules or units assuredly latched in mated condition with the receptacle connectors during substantial vibration over extended in-service use.

Figure 9:
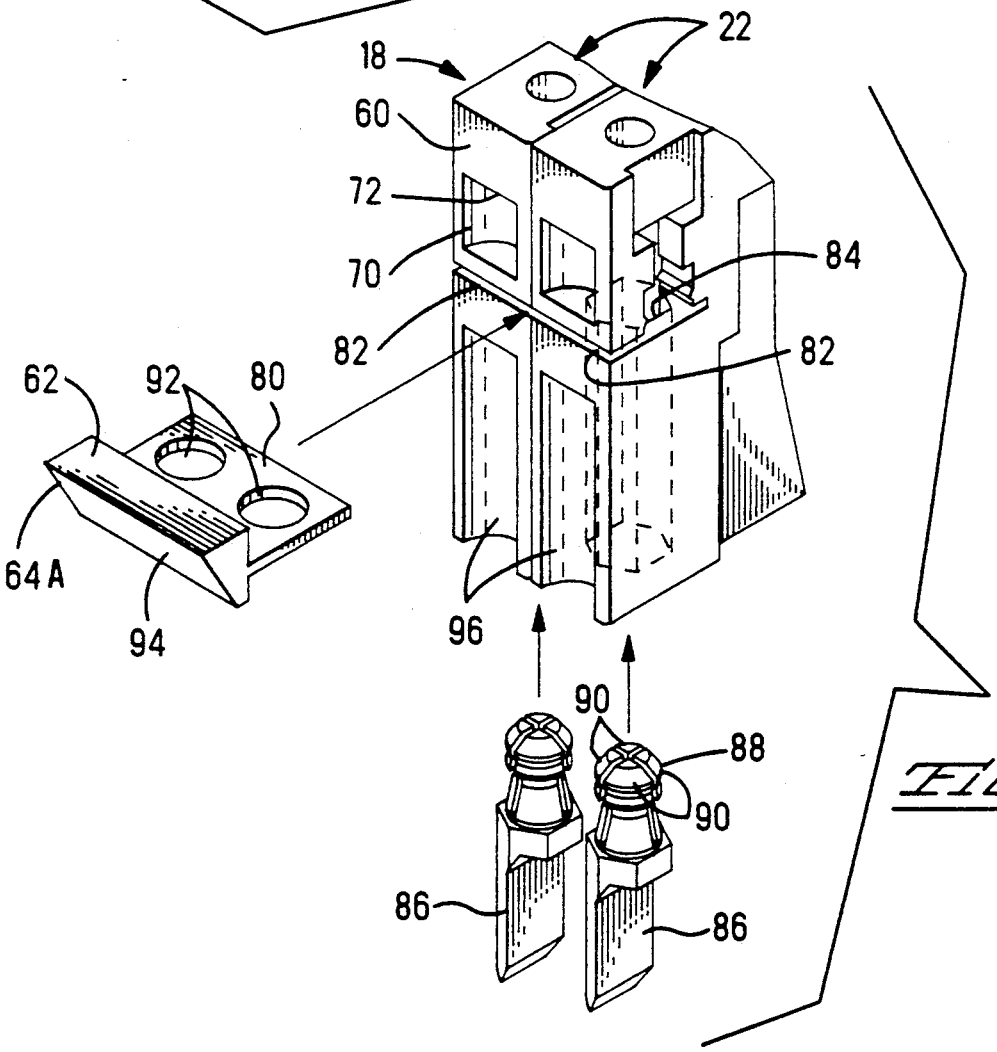
FIG. 9 is an enlarged perspective view illustrating a ganging member for latching two plug modules together at coplanar sides thereof to define a multi-module unit, showing one method of securing it to each module by using an inner end of a key member used in such a plug module for keying with the appropriate receptacle connector.

A plug module 22 may be adapted for use with the retention/ejection system of the present invention by using a ganging member 64 defining upwardly facing latching surface 62. Referring to FIG. 9, ganging member 64A is of a length to secure together two plug modules 22 to define a two-module unit 18. Ganging member 64A includes an inwardly extending section 80 received into a horizontal slot 82 into each plug module 22 of unit 18. Horizontal slot 82 intersects key-receiving aperture 84 extending inwardly from the mating face of the plug module within which a key member 86 is self-retaining in an appropriate angular orientation for keying purposes with a cooperable corresponding key member of the receptacle connector as disclosed in U.S. Pat. No. 4,778,411; rearward end 88 of key member 86 comprises inwardly deflectable quadrant sections 90.

For assembly of ganging member 64A to plug modules 22 in FIG. 9, ganging member 64A is first placed appropriately within a slot 82 so that aperture 92 is aligned with and intersects key-receiving aperture 84 of module 22. Then key member 86 is inserted fully into key-receiving aperture 84 of module 22 with rearward end 88 extending through aperture 92 of ganging member 64A, thus simultaneously securing key member 86 in module 22 and securing module 22 to ganging member 64A. Outwardly facing surface 94 of ganging member 64A is angled downwardly to facilitate initial insertion of plug module unit 18 into its receptacle connector by deflecting a cap 36 secured on free ends of the latch arms which will latch unit 18 fully mated within its receptacle connector. Preferably ganging members 64 are made of metal such as stainless steel for durability.

Also seen in FIG. 9 are hemispherical vertical channels 96 cooperable with alignment posts of the receptacle connector during mating.

Figures 10, 11:
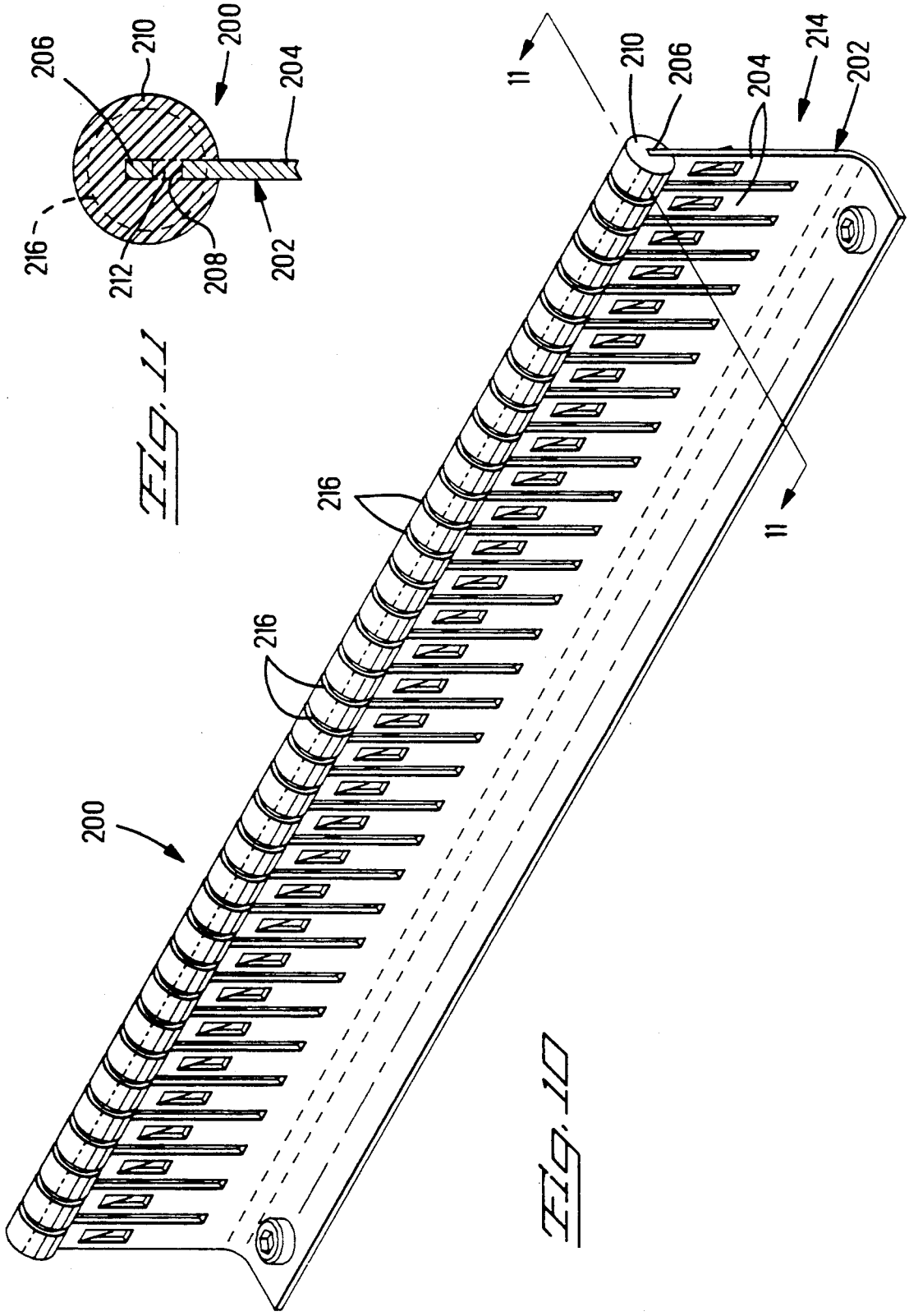
FIGS. 10 and 11 show an alternate embodiment of a bracket member of the present invention during fabrication thereof prior to programming, with FIG. 11 showing a latch arm free end in cross-section having a cylindrical plastic cap molded thereon.

FIGS. 10 and 11 illustrate an alternate embodiment of the bracket assembly of the present invention usable without a tool such as tool 100 by manual deflection of the ganged latch arms if desired. Bracket assembly 200 includes a bracket member 202 and a plurality of cantilever spring latch arms 204 extending upwardly to free ends 206, each having a hole 208 therethrough. A continuous boss cylinder 210 is first molded of plastic to all free ends 206 secured onto each by an integral column joint 212 extending through each hole 208, to define an unprogrammed assembly 214. Unprogrammed assembly 214 is then programmable for a selected connector array by severing cylinder 210 between those latch arms which are outermost latch arms of each set to be maintained ganged together to be deflectable as a unit for use with a multi-module unit of a like number of plug modules. Preferably a narrow reduced diameter annulus 216 is molded into the surface of cylinder 210 between each pair of adjacent latch arms 204 to precisely initially locate the severing tooling (not shown).

Various modifications may be devised to adapt the present invention to particular situations or plug modules or receptacle connectors of slightly different design, which are within the spirit of the invention and the scope of the claims.

What is claimed is:

1. A system for releasably retaining a plurality of modules in an array on a transverse panel, comprising:

a pair of parallel opposing bracket assemblies secured to said transverse panel spaced apart at an array site, each bracket assembly including at least an integral bracket member having a body section having at least a portion thereof mounted against and along a surface of said panel, and each bracket member including a plurality of cantilever spring latch arms coextending from said body section at each site of a module and perpendicularly away from said panel surface to respective free ends at least deflectable in a direction away from the other said bracket assembly said latch arms of both said bracket members being associated in opposing parallel pairs at a said module site spaced apart for receipt of a respective said module therebetween, said latch arms defining opposing arrays of panel-remote free ends;

each said latch arm of each said pair including a means for retaining a said module in cooperation with retention means of said module when a said module is positioned in said array adjacent and between said pair of latch arms;

each said latch arm free end being adapted to be engaged to be deflected away from the opposing said bracket assembly by a said module upon insertion of said module between a said pair of opposing latch arms in a direction from said free end toward said panel surface, said latch arms resiling toward said module upon complete positioning thereof in said array at a said module site to engage said retaining means and said module retention means;

at least one said latch arm free end including thereon a cap shaped to define a bearing surface engageable by a leading edge of a side portion of a said module without snagging, to initiate said latch arm deflection outwardly from said module side portion; and each said latch arm free end being adapted to be deflectable away from the opposing said bracket assembly to become disengaged from a said module positioned in a module site, for removal of said module, whereby a said module is retainable in said array by a pair of opposing latch arms independently of other modules separate from said module in said array and is easily removable from said array while said opposing bracket assemblies retain said other separate modules in said array.

2. A system as set forth in claim 1 wherein said latch arm free ends are aligned in a common row and each said cap is an embossment aligned in a direction along said common row.

3. A system as set forth in claim 1 wherein said cap includes a module-facing surface including a means for locating and guiding a work end of an ejection tool being inserted between said latch arm and a side portion of said module, to locate said tool work end along said module side portion and guide said tool work end therealong for ejection means of said tool work end to be aligned with a cooperating ejection means of said module, whereby said module is ejectable by tool work ends inserted along said side portion of said module and an opposing side portion thereof upon engagement of said ejection means and said cooperating ejection means along both said module side portions after simultaneous disengagement of said retaining means and said module retention means along said side portion and said opposing side portion of said module upon pulling of said tool work ends outwardly from said panel.

4. A system as set forth in claim 1 wherein each said means for retaining a module is a lance extending toward said panel surface and angled toward said opposing bracket assembly, said lance having a free end for latchably engaging a rearwardly facing surface of a said module upon full insertion of said module between opposing said latch arms of a said latch arm pair.

5. A system as set forth in claim 1 wherein said latch arm free ends are aligned in a common row and at least two adjacent ones of said latch arm free ends include a common cap secured thereon joining said adjacent latch arm free ends and being shaped to define a bearing surface engageable by a leading edge of a side portion of at least one of a pair of ganged adjacent modules without snagging, to initiate deflection of said adjacent latch arms outwardly as a unit from said module side portion, whereby only one portion of said common cap need be engaged to deflect both said adjacent latch arms outwardly simultaneously.

6. A system as set forth in claim 5 wherein said common cap includes a module-facing surface including a means for locating and guiding a work end of an ejection tool being inserted between said adjacent latch arms and side portions of said ganged adjacent modules, to locate said tool work end along a side portion of one of said ganged adjacent modules and guide said tool work end therealong for ejection means of said tool work end to be aligned with a cooperating ejection means of said one of said adjacent ganged modules, whereby said adjacent ganged modules are ejectable by tool work ends inserted along said side portion of said module and an opposing side portion thereof upon engagement of said ejection means and said cooperating ejection means along both said module side portions after simultaneous disengagement of said retaining means and said module retention means along side portions and opposing side portions of all said modules of said adjacent ganged modules.

7. A system as set forth in claim 6 wherein said common cap secures together free ends of an odd number of latch arms for simultaneous deflection thereof as a unit, and said means for locating and guiding a tool work end is disposed centrally therealong at a site of a center module of a ganged assembly of a corresponding odd number of modules, facilitating assured simultaneous deflection and delatching of said odd number of latch arms by said tool work end and locating and aligning said tool work end with said center module.

8. A system as set forth in claim 6 wherein said common cap secures together free ends of an even number of latch arms for simultaneous deflection thereof as a unit, and said common cap includes a second said means for locating and guiding a tool work end, both said means and said second means being disposed relatively centrally along said common cap and at respective sites of two center modules of a ganged assembly of a corresponding even number of modules, facilitating assured simultaneous deflection and delatching of said even number of latch arms by said tool work end and locating and aligning said tool work end with either of said center modules.

9. A tool for use with a system for releasably retaining a plurality of modules in an array at respective module sites on a panel, the system including a pair of opposing bracket assemblies mounted to the panel and defining opposing arrays of cantilever spring latch arms extending outwardly from the panel in opposing pairs at each module site of the array and associated with opposing sides of respective modules of the module array, each of the latch arms being deflectable outwardly from the associated side of the respective module and including means for retaining a module positioned in the module array in cooperation with retention means along the side of the respective module, said tool comprising:

a bight section and a pair of arms coextending perpendicularly from opposed ends of said bight section to respective work ends, said work ends including respective ejection means aligned with each other cooperable with corresponding ejection means along corresponding sides of a selected module for ejection of said selected module, and said work ends including bearing surfaces engageable with free ends of latch arms of an opposing pair associated with said selected module and adapted to deflect said latch arms outwardly away from said sides of said module to disengage retaining means of said latch arms from retention means of said selected module, said bight section having a pair of bight portions pivotably joined at a median location in a manner permitting incremental pivoting thereat between a first angular position and a second angular position along an axis perpendicular to said bight section and perpendicular to said arms, for said coextending arms to be pivotable incrementally at least toward each other during final stages of insertion of said arms along said corresponding sides of said selected module for assured engagement of said ejection means and said corresponding ejection means, to enable module ejection.

10. The tool as set forth in claim 9 wherein outwardly facing surfaces of said tool arm work ends are angled forwardly defining bearing surfaces engageable with said latch arm free ends during initial stages of tool insertion to facilitate outward deflection of said latch arms.

11. The tool as set forth in claim 9 wherein said pivotable joint comprises inner ends of said bight portions, each inner end defining at least a pair of plate-receiving recesses alternating with at least a pair of plate sections extending toward the other said inner end, so that upon said inner ends being moved together said plate sections of each said inner end enter said plate-receiving recesses of the other until leading end surfaces of said plate sections abut surfaces defining ends of said plate-receiving recesses, and said plate sections including pin-receiving holes aligned after said plate sections are interleafed for receipt of a pivot pin therethrough.

12. The tool as set forth in claim 11 wherein one of said leading ends of said plate sections and said recess end surfaces comprise upper and lower portions angled slightly outwardly whereby the other of said leading ends and recess ends can abut one of said upper and lower portions at said first angular position and the other thereof at said second angular position, defining pivot stops when said bight portions are pivotted about said pivot pin.

13. The tool as set forth in claim 9 wherein said ejection means comprises projections extending from respective said tool arms toward each other, and said corresponding ejection means are projection-receiving recesses into each said corresponding module side.

14. The tool as set forth in claim 13 wherein said pivotable joint of said bight section permits incremental outward pivoting of said tool arms as said ejection projections initially engage a rear edge of said selected module at an associated side thereof to allow said tool arms to continue insertion along said associated module sides, whereafter said latch arms pivot said pivotable tool arms inwardly upon completion of tool insertion to assure said ejection projections entering into said projection-receiving recesses of each said module side.

15. The tool as set forth in claim 9 wherein said tool arms include guide means for cooperating with corresponding guide means along a module-facing side of a said latch arm free end at a module site, for guiding tool movement during tool insertion along said associated sides of said selected module.

16. The tool as set forth in claim 15 wherein said guide means of said tool arms comprise channels extending toward said bight section, for receiving thereinto and therealong a corresponding projection of said latch arm free end.

17. An article for fastening together a plurality of modules to be handled as a unit when used with a like article, each module including a mating face and opposing sides extending rearwardly from said mating face, and each module unit to be secured in an array on a panel, consisting of a module-fastening portion adapted to be fastened to one of said sides of each said module at module sites therealong, and a latching portion exposed along said module sides to define a continuous surface facing rearwardly from said mating face orthogonal to and extending outwardly from and transversely along all said module sides adjacent thereto, whereby upon module unit insertion between a pair of latching means of said panel having corresponding latching projections which are engageable behind said latching surface and an opposed latching surface of a like article fastened on an opposing side of said module unit, said module unit is latchingly secured to said panel.

* * * * *